US005484126A

United States Patent [19]

Kitchin

[11] Patent Number: 5,484,126

[45] Date of Patent: Jan. 16, 1996

[54] SURFACE PIERCING SHEET RETAINER

[76] Inventor: Irene W. Kitchin, P.O. Box 250, Jamul, Calif. 91935

[21] Appl. No.: 378,563

[22] Filed: Jan. 26, 1995

[51] Int. Cl.[6] ..... A47B 96/06

[52] U.S. Cl. ..... 248/217.3; 24/DIG. 10; 248/216.1; 248/218.1

[58] Field of Search ..... 248/303, 218.2, 248/218.1, 216.1, 219.3; 24/600.9, 67.11, 369, 370, 598.1, DIG. 10

[56] References Cited

U.S. PATENT DOCUMENTS 306,294 10/1884 Thurston ..... 24/67.11 U X
377,824 2/1888 Durnil ..... 24/DIG. 10
1,247,912 11/1917 Wardner ..... 248/216.1
1,567,851 12/1925 Lorber ..... 24/67.11 U X
2,510,508 6/1950 Mayer ..... 248/218.2 U X

FOREIGN PATENT DOCUMENTS 417535 8/1925 Germany ..... 248/216.1

*Primary Examiner*—J. Franklin Foss

[57] ABSTRACT

A retainer for securing a planar sheet relative to a support surface. The inventive device includes a mounting assembly which can be piercingly engaged to a vertical wall. An engagement assembly depends from the mounting assembly for coupling to a sheet of paper and includes a hook member projecting therefrom for engaging a pierced object for suspension thereof relative to the wall.

11 Claims, 3 Drawing Sheets

SURFACE PIERCING SHEET RETAINER

BACKGROUND OF THE INVENTION

1. Field of the Invention

The present invention relates to mounting devices and more particularly pertains to an surface piercing sheet retainer for securing a planar sheet relative to a support surface.

2. Description of the Prior Art

The use of mounting devices is known in the prior art. More specifically, mounting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art mounting devices include U.S. Pat. No. 4,901,961; U.S. Pat. No. Des. 271,214; U.S. Pat. No. 3,861,015; U.S. Pat. No. 4,903,379; and U.S. Pat. No. Des. 251,124.

While these devices fulfill their respective, particular objectives and requirements, the aforementioned patents do not disclose a surface piercing sheet retainer for securing a planar sheet relative to a support surface which includes a mounting assembly piercingly engagable to a vertical wall, and an engaging assembly depending from the mounting assembly for coupling to a sheet of paper, wherein the engaging assembly includes a hook member projecting therefrom for engaging a pierced object for suspension thereof relative to the wall.

In these respects, the surface piercing sheet retainer according to the present invention substantially departs from the conventional concepts and designs of the prior art, and in so doing provides an apparatus primarily developed for the purpose of securing a planar sheet relative to a support surface.

SUMMARY OF THE INVENTION

In view of the foregoing disadvantages inherent in the known types of mounting devices now present in the prior art, the present invention provides a new surface piercing sheet retainer construction wherein the same can be utilized for securing a planar sheet relative to support surface. As such, the general purpose of the present invention, which will be described subsequently in greater detail, is to provide a new surface piercing sheet retainer apparatus and method which has many of the advantages of the mounting devices mentioned heretofore and many novel features that result in a surface piercing sheet retainer which is not anticipated, rendered obvious, suggested, or even implied by any of the prior art mounting devices, either alone or in any combination thereof.

To attain this, the present invention generally comprises a retainer for securing a planar sheet relative to a support surface. The inventive device includes a mounting assembly which can be piercingly engaged to a vertical wall. An engagement assembly depends from the mounting assembly for coupling to a sheet of paper and includes a hook member projecting therefrom for engaging a pierced object for suspension thereof relative to the wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Pat. and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new surface piercing sheet retainer apparatus and method which has many of the advantages of the mounting devices mentioned heretofore and many novel features that result in a surface piercing sheet retainer which is not anticipated, rendered obvious, suggested, or even implied by any of the prior art mounting devices, either alone or in any combination thereof.

It is another object of the present invention to provide a new surface piercing sheet retainer which may be easily and efficiently manufactured and marketed.

It is a further object of the present invention to provide a new surface piercing sheet retainer which is of a durable and reliable construction.

An even further object of the present invention is to provide a new surface piercing sheet retainer which is susceptible of a low cost of manufacture with regard to both materials and labor, and which accordingly is then susceptible of low prices of sale to the consuming public, thereby making such surface piercing sheet retainers economically available to the buying public.

Still yet another object of the present invention is to provide a new surface piercing sheet retainer which provides in the apparatuses and methods of the prior art some of the advantages thereof, while simultaneously overcoming some of the disadvantages normally associated therewith.

Still another object of the present invention is to provide a new surface piercing sheet retainer for securing a planar sheet relative to a support surface.

Yet another object of the present invention is to provide a new surface piercing sheet retainer which includes a mounting assembly piercingly engagable to a vertical wall, and an engaging assembly depending from the mounting assembly for coupling to a sheet of paper.

Even still another object of the present invention is to provide a new surface piercing sheet retainer wherein the engaging assembly includes a hook member projecting therefrom for engaging a pierced object for suspension thereof relative to the wall.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
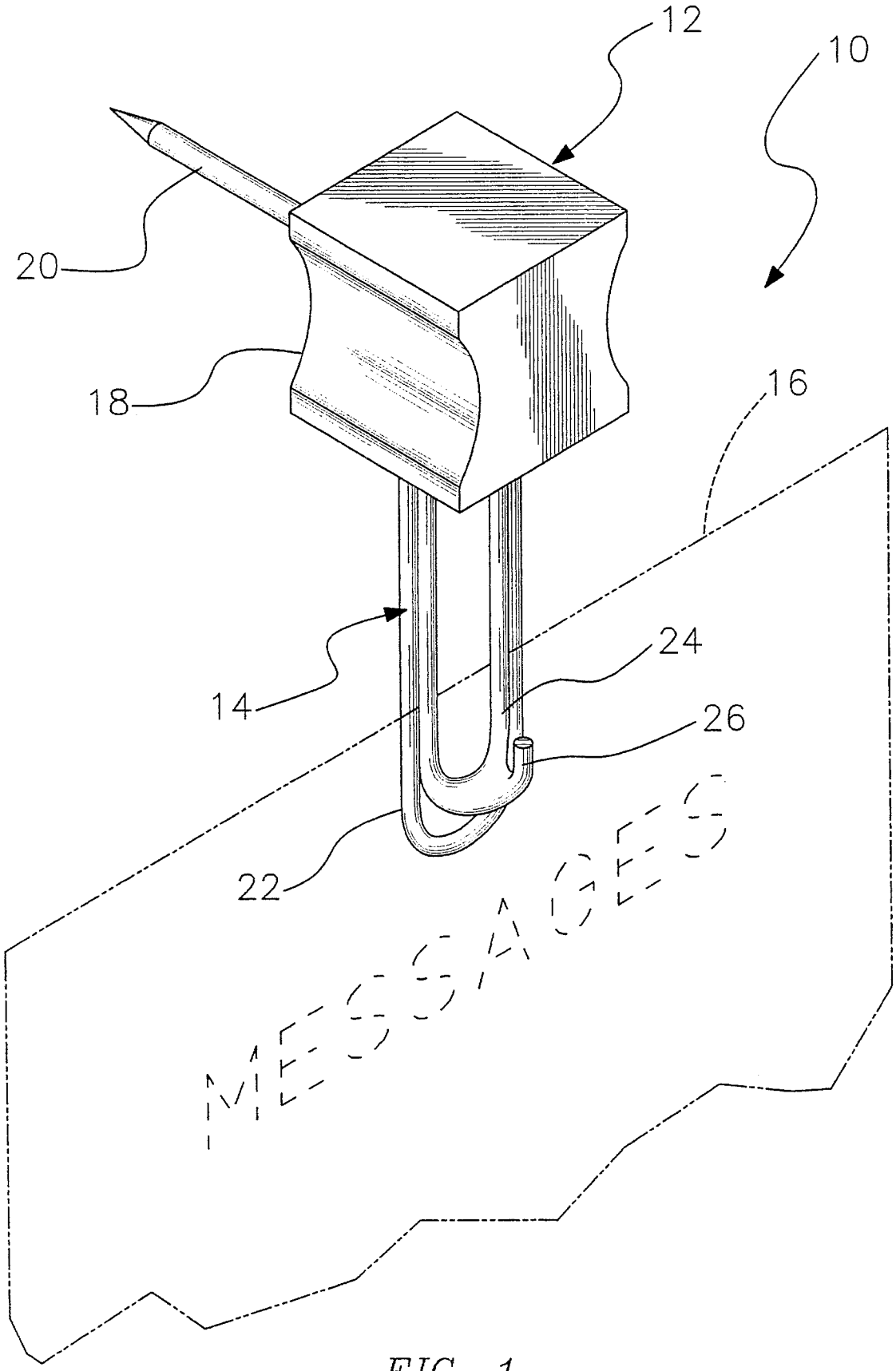
FIG. 1 is an isometric illustration of a surface piercing sheet retainer according to the present invention in use.
Figure 2:
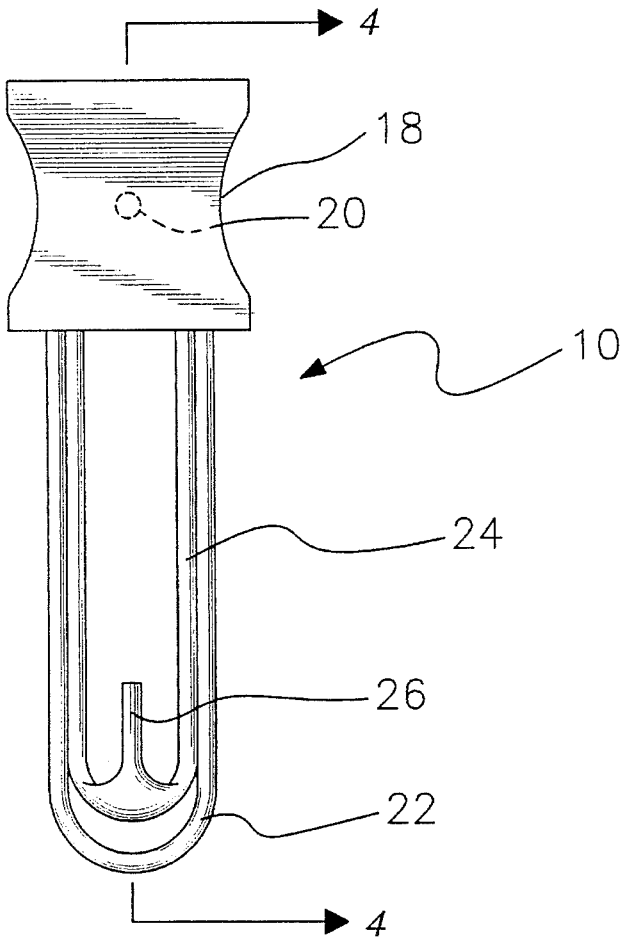
FIG. 2 is a front elevation view of the invention, per se.
Figure 3:
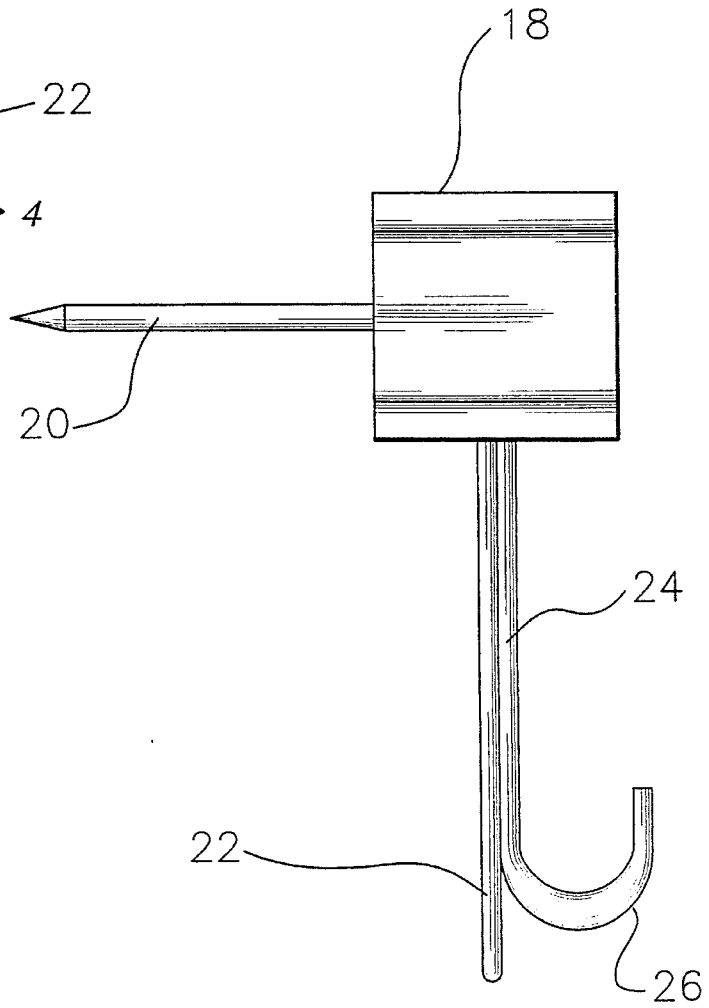
FIG. 3 is a side elevation view thereof. 4—4 of FIG. 2.
Figure 4:
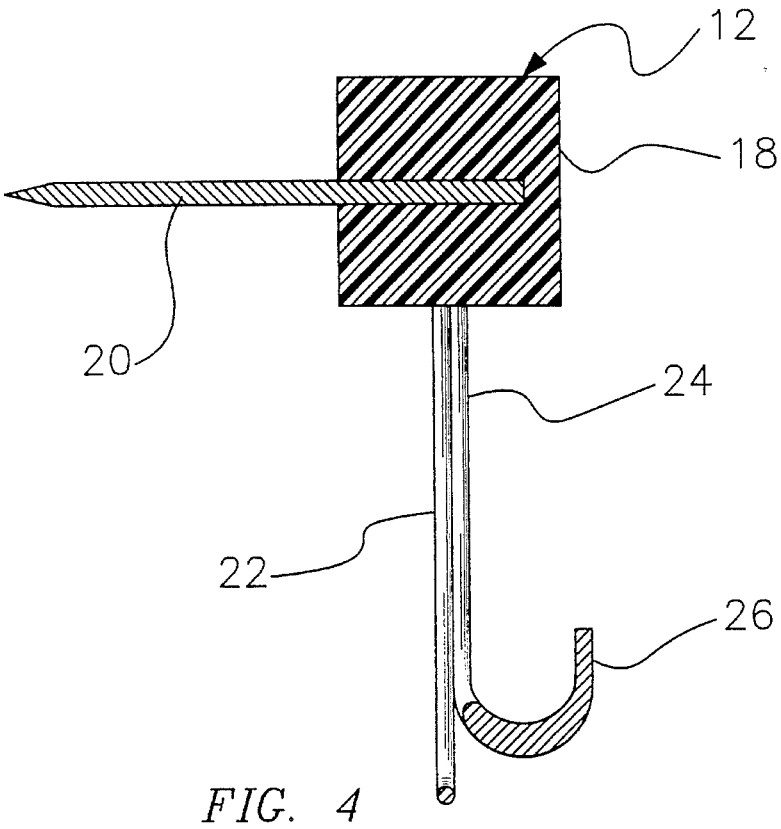
FIG. 4 is a cross sectional view taken along line

With reference now to the drawings, and in particular to FIGS. 1–5 thereof, a new surface piercing sheet retainer embodying the principles and concepts of the present invention and generally designated by the reference numeral 10 will be described.

More specifically, it will be noted that the surface piercing sheet retainer 10 comprises a mounting means 12 for piercingly engaging an unillustrated support surface. An engaging means 14 extends from the mounting means 12 for coupling to a planar sheet 16 of material, such as a sheet of paper or the like. By this structure, the planar sheet 16 can be suspended relative to the support surface as desired.

As best illustrated in FIGS. 1 through 4, it can be shown that the mounting means 12 according to the present invention 10 preferably comprises a gripping member 18 for being grasped and manipulated by an individual. A mounting pin 20 projects from the gripping member 18 for piercing insertion into a support surface such as vertical wall or the like. By this structure, the mounting means 12 can be easily engaged to a vertical wall surface or other similar supporting surface and rotatably positioned relative thereto as desired by an end user.

With continuing reference to FIGS. 1 through 4, it can be shown that the engaging means 14 according to the present invention 10 preferably comprises a first depending loop 22 projecting from the gripping member 18 of the mounting means 12. Preferably, the first depending loop 22 is oriented so as to extend substantially orthogonally relative to the mounting pin 20 as shown in the drawings. A second depending loop 24 projects from the gripping member 18 of the mounting means 12 and into a substantially parallel orientation relative to the first depending loop 22. Preferably, the first depending loop 22 is of a first longitudinal length, with the second depending loop 24 being of a second longitudinal length, wherein the first longitudinal length is substantially greater than the second longitudinal length as shown in the drawings. Further, the first depending loop 22 is preferably of a first transverse width, with the second depending loop 24 being of a second transverse width, wherein the first transverse width is substantially greater than the second transverse width as shown in the drawings. By this structure, the second depending loop 24 is permitted to pass through an interior of the first depending loop 22 during resilient deformation of the engaging means 14 as desired. Preferably, the first depending loop 22 normally resides within a first plane, and the second depending loop 24 normally resides within a second plane oriented substantially spaced and parallel relative to the first plane such that the planar sheet 16, such as a sheet of paper or the like, can be positioned between the depending loops 22 and 24 for capturing and retaining therebetween.

To facilitate suspension of an object having an aperture or hole directed therethrough, the engaging means 14, as shown in FIGS. 1 through 4, may further comprise a hook member 26 projecting from the second depending loop 24. The hook member 26 is thus operable to be inserted through an aperture or hole within an object to facilitate suspension of such object relative to the mounting means 12.

Figure 5:
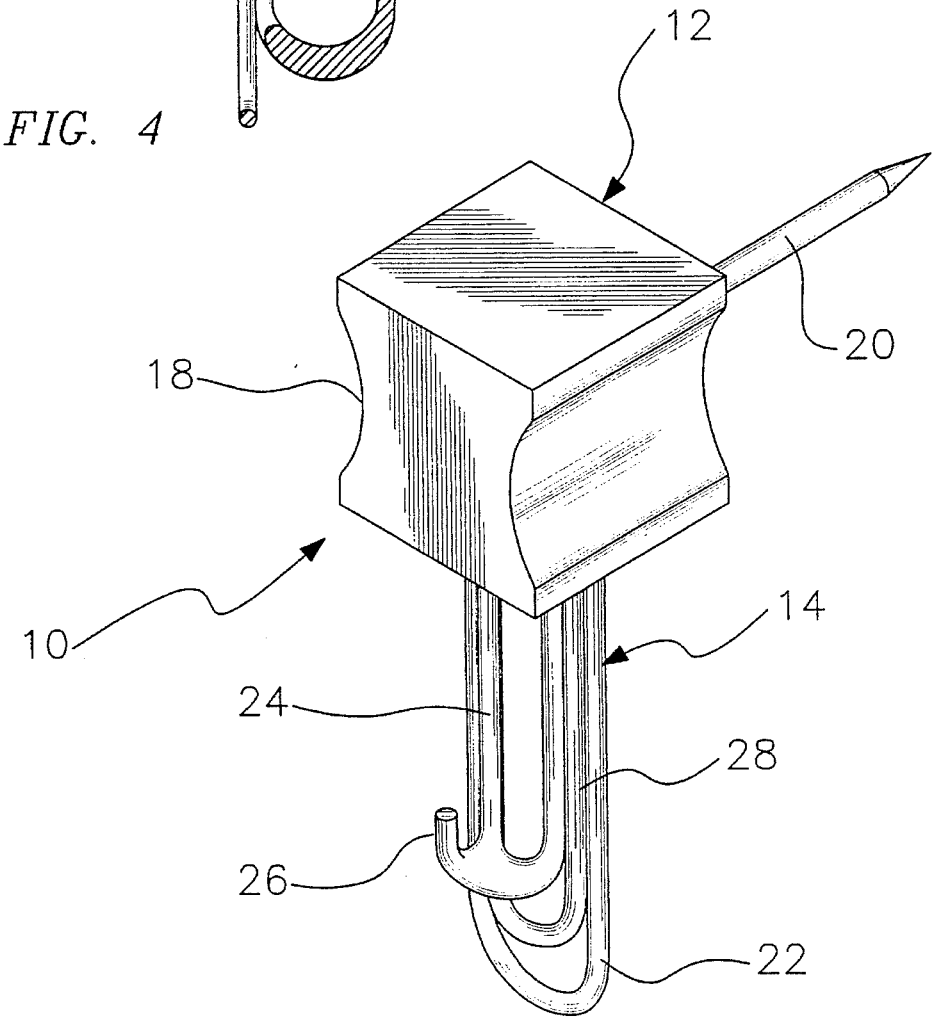
FIG. 5 is an isometric illustration an alternative form of the present invention.

Referring now to FIG. 5, it can be shown that the engaging means 14 according to the present invention 10 may further comprise an intermediate depending loop 28 extending from the mounting means 12 and between the second depending loop 24 and the first depending loop 22. Accordingly, the intermediate depending loop 28 is of a third longitudinal length, wherein the first longitudinal length of the first depending loop 22 is substantially greater than the third longitudinal length and the second longitudinal length of the second depending loop 24 is substantially less than the third longitudinal length. Further, the intermediate depending loop 28 is of a third transverse width, wherein the first transverse width of the first depending loop 22 is substantially greater than the third transverse width and the second transverse width of the second depending loop 24 is substantially less than the third transverse width. By this structure, the intermediate depending loop 28 is substantially concentrically positioned relative to the first and second depending loops 22 and 24. The alternative form of the present invention 10 including the intermediate depending loop 28 of the engaging means 14 permits a plurality of planar sheets 16 to be independently engaged between adjacent pairs of depending loops 22, 24, and 28.

In use, the surface piercing sheet retainer 10 according to the present invention can be easily engaged to a vertical wall surface and rotatably oriented into a desired position. A planar sheet 16 such as a standard piece of paper or the like can be engaged to the engaging means 14 to facilitate suspension of the planar sheet 16 relative to the mounting means 12. A pierced or apertured object can than be hung from the hook member 26 if so desired. The alternative form of the present invention 10 illustrated in FIG. 5 permits a plurality of such planar sheets 16 to be independently suspended from the engaging means 14 wherein one or more of the planar sheets can be independently separated without disturbing the suspension of adjacent sheets.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A surface piercing sheet retainer comprising:

a mounting means for piercingly engaging a support surface;

an engaging means extending from the mounting means for coupling to a planar sheet of material such that the planar sheet can be suspended relative to the support surface;

wherein the engaging means extends substantially orthogonally from a longitudinal axis directed through the mounting means;

wherein the mounting means comprises a gripping member for being grasped and manipulated by an individual; and a mounting pin projecting from the gripping member for piercing insertion into a support surface, wherein the mounting means can be rotatably positioned relative to the support surface;

wherein the engaging means comprises a first depending loop projecting from the gripping member of the mounting means; and a second depending loop projecting from the gripping member of the mounting means and into a substantially parallel orientation relative to the first depending loop;

wherein the first depending loop is of a first longitudinal length, with the second depending loop being of a second longitudinal length, wherein the first longitudinal length is substantially greater than the second longitudinal length;

wherein the first depending loop is of a first transverse width, with the second depending loop being of a second transverse width, wherein the first transverse width is substantially greater than the second transverse width such that the second depending loop is permitted to pass through an interior of the first depending loop;

wherein the first depending loop resides within a first plane, and the second depending loop resides within a second plane oriented substantially spaced and parallel relative to the first plane;

and further comprising a hook member projecting from the second depending loop.

2. The surface piercing sheet retainer of claim 1, wherein the engaging means further comprises an intermediate depending loop extending from the mounting means and between the second depending loop and the first depending loop, the intermediate depending loop being of a third longitudinal length, wherein the first longitudinal length of the first depending loop is substantially greater than the third longitudinal length, and further wherein the second longitudinal length of the second depending loop is substantially less than the third longitudinal length.

3. The surface piercing sheet retainer of claim 2, wherein the intermediate depending loop is of a third transverse width, wherein the first transverse width of the first depending loop is substantially greater than the third transverse width, and further wherein the second transverse width of the second depending loop is substantially less than the third transverse width.

4. The surface piercing sheet retainer of claim 1, wherein the engaging means comprises a first depending loop projecting from the mounting means; and a second depending loop projecting from the mounting means and into a substantially parallel orientation relative to the first depending loop.

5. The surface piercing sheet retainer of claim 4, wherein the first depending loop is of a first longitudinal length, with the second depending loop being of a second longitudinal length, wherein the first longitudinal length is substantially greater than the second longitudinal length.

6. The surface piercing sheet retainer of claim 5, wherein the first depending loop is of a first transverse width, with the second depending loop being of a second transverse width, wherein the first transverse width is substantially greater than the second transverse width such that the second depending loop is permitted to pass through an interior of the first depending loop.

7. The surface piercing sheet retainer of claim 6, wherein the first depending loop resides within a first plane, and the second depending loop resides within a second plane oriented substantially spaced and parallel relative to the first plane.

8. The surface piercing sheet retainer of claim 7, and further comprising a hook member projecting from the second depending loop.

9. The surface piercing sheet retainer of claim 8, wherein the engaging means further comprises an intermediate depending loop extending from the mounting means and between the second depending loop and the first depending loop, the intermediate depending loop being of a third longitudinal length, wherein the first longitudinal length of the first depending loop is substantially greater than the third longitudinal length, and further wherein the second longitudinal length of the second depending loop is substantially less than the third longitudinal length.

10. The surface piercing sheet retainer of claim 9, wherein the intermediate depending loop is of a third transverse width, wherein the first transverse width of the first depending loop is substantially greater than the third transverse width, and further wherein the second transverse width of the second depending loop is substantially less than the third transverse width.

11. A surface piercing sheet retainer comprising:

a mounting means for piercingly engaging a support surface;

an engaging means extending from the mounting means for coupling to a planar sheet of material such that the planar sheet can be suspended relative to the support surface;

wherein the engaging means extends substantially orthogonally from a longitudinal axis directed through the mounting means;

wherein the mounting means comprises a gripping member for being grasped and manipulated by an individual; and a mounting pin projecting from the gripping member for piercing insertion into a support surface, wherein the mounting means can be rotatably positioned relative to the support surface;

and further comprising a hook member projecting from the second depending loop.

* * * * *